US009793616B2

(12) United States Patent
Ouyang et al.

(10) Patent No.: US 9,793,616 B2
(45) Date of Patent: Oct. 17, 2017

(54) SHARED ANTENNA STRUCTURES FOR NEAR-FIELD COMMUNICATIONS AND NON-NEAR-FIELD COMMUNICATIONS CIRCUITRY

(71) Applicant: Apple Inc., Cupertino, CA (US)

(72) Inventors: Yuehui Ouyang, Sunnyvale, CA (US); Robert W. Schlub, Cupertino, CA (US); Nanbo Jin, Sunnyvale, CA (US); Mattia Pascolini, San Mateo, CA (US)

(73) Assignee: Apple Inc., Cupertino, CA (US)

( * ) Notice: Subject to any disclaimer, the term of this patent is extended or adjusted under 35 U.S.C. 154(b) by 1055 days.

(21) Appl. No.: 13/681,138

(22) Filed: Nov. 19, 2012

(65) Prior Publication Data

US 2014/0139380 A1 May 22, 2014

(51) Int. Cl.
*H01Q 1/24* (2006.01)
*H01Q 21/30* (2006.01)
(Continued)

(52) U.S. Cl.
CPC ..... *H01Q 21/30* (2013.01); *H01Q 1/243* (2013.01); *H01Q 5/20* (2015.01); *H01Q 5/314* (2015.01);
(Continued)

(58) Field of Classification Search
CPC ..... H01Q 21/30
(Continued)

(56) References Cited

U.S. PATENT DOCUMENTS 5,936,583 A 8/1999 Sekine et al.
6,308,051 B1 10/2001 Atokawa
(Continued)

FOREIGN PATENT DOCUMENTS

EP 2498336 9/2012
EP 2528165 11/2012
(Continued)

OTHER PUBLICATIONS

"Antenna Theory: A Review," Balanis, Proc. IEEE vol. 80 No. 1 Jan. 1992.*
(Continued)

*Primary Examiner* — Graham Smith
(74) *Attorney, Agent, or Firm* — Treyz Law Group, P.C.; G. Victor Treyz; Michael H. Lyons

(57) ABSTRACT

Electronic devices may be provided that contain wireless communications circuitry. The wireless communications circuitry may include radio-frequency transceiver circuitry and antenna structures. The antenna structures may include conductive housing structures such as a peripheral conductive housing member. The antenna structures may be based on an inverted-F antenna resonating element or other types of antenna resonating element. An electronic device may have near field communications circuitry and non-near-field communications circuitry such as cellular telephone, satellite navigation system, or wireless local area network transceiver circuitry. Antenna structures may be configured to handle signals associated with the non-near-field communications circuitry. The antenna structures may also have portions that form a near field communications loop antenna for handling signals associated with the near field communications circuitry.

21 Claims, 9 Drawing Sheets

(51) Int. Cl.

| | |
|---|---|
| ***H01Q 7/00*** | (2006.01) |
| ***H01Q 9/04*** | (2006.01) |
| ***H01Q 21/28*** | (2006.01) |
| ***H01Q 5/20*** | (2015.01) |
| ***H01Q 5/314*** | (2015.01) |

(52) U.S. Cl.
CPC ..... *H01Q 7/00* (2013.01); *H01Q 9/0421* (2013.01); *H01Q 21/28* (2013.01)

(58) Field of Classification Search
USPC ..... 343/702
See application file for complete search history.

(56) References Cited

U.S. PATENT DOCUMENTS

| | | | |
|---|---|---|---|
| 6,556,630 | B1 | 4/2003 | Brinsfield et al. |
| 6,600,450 | B1 | 7/2003 | Efanov et al. |
| 6,950,410 | B1 | 9/2005 | Brandt |
| 7,408,515 | B2 | 8/2008 | Leisten |
| 7,423,606 | B2 | 9/2008 | Knadle, Jr. et al. |
| 7,450,072 | B2 | 11/2008 | Kim et al. |
| 7,505,001 | B2 | 3/2009 | Deavours et al. |
| 7,772,941 | B2 | 8/2010 | Yeung et al. |
| 7,834,813 | B2 | 11/2010 | Caimi et al. |
| 7,843,347 | B2 | 11/2010 | Nikitin et al. |
| 7,873,385 | B2 | 1/2011 | Boireau et al. |
| 7,973,722 | B1 | 7/2011 | Hill et al. |
| 8,041,227 | B2 | 10/2011 | Holcombe et al. |
| 8,238,825 | B2 | 8/2012 | Rofougaran et al. |
| 8,369,959 | B2 | 2/2013 | Meskens |
| 8,417,296 | B2 | 4/2013 | Caballero et al. |
| 8,432,322 | B2 | 4/2013 | Amm et al. |
| 8,466,839 | B2 | 6/2013 | Schlub et al. |
| 8,577,289 | B2 | 11/2013 | Schlub et al. |
| 8,606,215 | B2 | 12/2013 | Sharma |
| 8,818,450 | B2 | 8/2014 | Caballero et al. |
| 8,947,305 | B2 | 2/2015 | Amm et al. |
| 2006/0055618 | A1 | 3/2006 | Poilasne et al. |
| 2007/0279287 | A1 | 12/2007 | Castaneda et al. |
| 2008/0081631 | A1 | 4/2008 | Rofougaran |
| 2009/0058735 | A1 | 3/2009 | Hill et al. |
| 2009/0073070 | A1 | 3/2009 | Rofougaran |
| 2009/0143028 | A1 | 6/2009 | Kim |
| 2009/0180451 | A1 | 7/2009 | Alpert et al. |
| 2010/0007568 | A1 | 1/2010 | Fear et al. |
| 2010/0222010 | A1 | 9/2010 | Ozaki et al. |
| 2010/0279734 | A1 | 11/2010 | Karkinen et al. |
| 2011/0148733 | A1 | 6/2011 | Fahs et al. |
| 2011/0241949 | A1 | 10/2011 | Nickel et al. |
| 2011/0243120 | A1 | 10/2011 | Ginsburg et al. |
| 2012/0258660 | A1 | 10/2012 | Rajendran et al. |
| 2012/0299785 | A1 | 11/2012 | Bevelacqua |
| 2013/0002511 | A1 | 1/2013 | Higaki et al. |
| 2013/0017867 | A1 | 1/2013 | Lee et al. |
| 2013/0019413 | A1 | 1/2013 | Velazquez et al. |
| 2013/0057446 | A1 | 3/2013 | Hirobe et al. |
| 2013/0109433 | A1 | 5/2013 | Wang et al. |
| 2013/0189923 | A1 | 7/2013 | Lewin |
| 2013/0194139 | A1 | 8/2013 | Nickel et al. |
| 2013/0217342 | A1 | 8/2013 | Abdul-Gaffoor et al. |
| 2013/0231046 | A1 | 9/2013 | Pope et al. |
| 2013/0241796 | A1 | 9/2013 | Nagumo et al. |
| 2013/0300618 | A1 | 11/2013 | Yarga et al. |
| 2014/0045442 | A1 | 2/2014 | Caruana et al. |
| 2014/0062812 | A1 | 3/2014 | Smith et al. |
| 2014/0128032 | A1 | 5/2014 | Muthukumar |
| 2014/0139380 | A1 | 5/2014 | Ouyang et al. |
| 2014/0306857 | A1 | 10/2014 | Bevelacqua et al. |
| 2014/0315592 | A1 | 10/2014 | Schlub et al. |
| 2014/0328488 | A1 | 11/2014 | Caballero et al. |
| 2015/0249292 | A1 | 9/2015 | Ouyang et al. |
| 2015/0249485 | A1 | 9/2015 | Ouyang et al. |

FOREIGN PATENT DOCUMENTS

| | | |
|---|---|---|
| EP | 2618497 | 7/2013 |
| KR | 10-2012-0084770 | 7/2012 |
| KR | 10-2012-0102516 | 9/2012 |
| KR | 2012-0103297 A | 9/2012 |
| TW | 201240379 | 10/2012 |
| WO | 2012127097 | 9/2012 |
| WO | 2013147823 | 10/2013 |

OTHER PUBLICATIONS

Irci et al., U.S. Appl. No. 14/262,486, filed Apr. 25, 2014.
Yarga et al., U.S. Appl. No. 14/254,604, filed Apr. 16, 2014.

* cited by examiner

SHARED ANTENNA STRUCTURES FOR NEAR-FIELD COMMUNICATIONS AND NON-NEAR-FIELD COMMUNICATIONS CIRCUITRY

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry such as near field communications circuitry. Near field communications schemes involve electromagnetically coupled communications over short distances, typically 20 cm or less.

To satisfy consumer demand for small form factor wireless devices, manufacturers are continually striving to implement wireless communications circuitry such as antenna components using compact structures. At the same time, there is a desire for wireless devices to cover a growing number of communications bands. For example, it may be desirable for a wireless device to cover a near field communications band while simultaneously covering additional non-near-field (far field) bands such cellular telephone bands, wireless local area network bands, and satellite navigation system bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

Electronic devices may be provided that contain wireless communications circuitry. The wireless communications circuitry may include radio-frequency transceiver circuitry and antenna structures. The radio-frequency transceiver circuitry may include near field communications circuitry that operates in a near field communications band. The radio-frequency transceiver circuitry may also include non-near-field-communications circuitry (far field communications circuitry) such as such as cellular telephone, satellite navigation system, or wireless local area network transceiver circuitry. The non-near-field communications circuitry may operate in one or more non-near-field communications bands.

The antenna structures may include conductive housing structures such as a peripheral conductive housing member. The antenna structures may be based on an inverted-F antenna resonating element or may have other types of antenna resonating element. The antenna structures may be configured to handle signals associated with the non-near-field communications circuitry such as cellular telephone signals, satellite navigation system signals, or wireless local area network signals. The antenna structures may also be used to form a near field communications loop antenna. The near field communications loop antenna may handle signals associated with the near field communications circuitry. Sharing the antenna structures between near field and non-near-field applications allows device size to be minimized.

Antenna structures may be provided with paths that form multiple loops for the loop antenna. The loops may be formed at different locations within an inverted-F antenna resonating element or may be concentric.

Antenna structures may be formed at opposing ends of an electronic device. Combining circuitry may allow the near field communications circuitry and the non-near-field communications circuitry to be coupled to common antenna structures. In configurations for an electronic device that include antenna structures at opposing ends of the device, near field communications signals may be transmitted and received at both ends of the device. Near field communications signals may also be transmitted from front and rear faces of an electronic device.

Further features of the invention, its nature and various advantages will be more apparent from the accompanying drawings and the following detailed description of the preferred embodiments.

DETAILED DESCRIPTION

Figure 1:
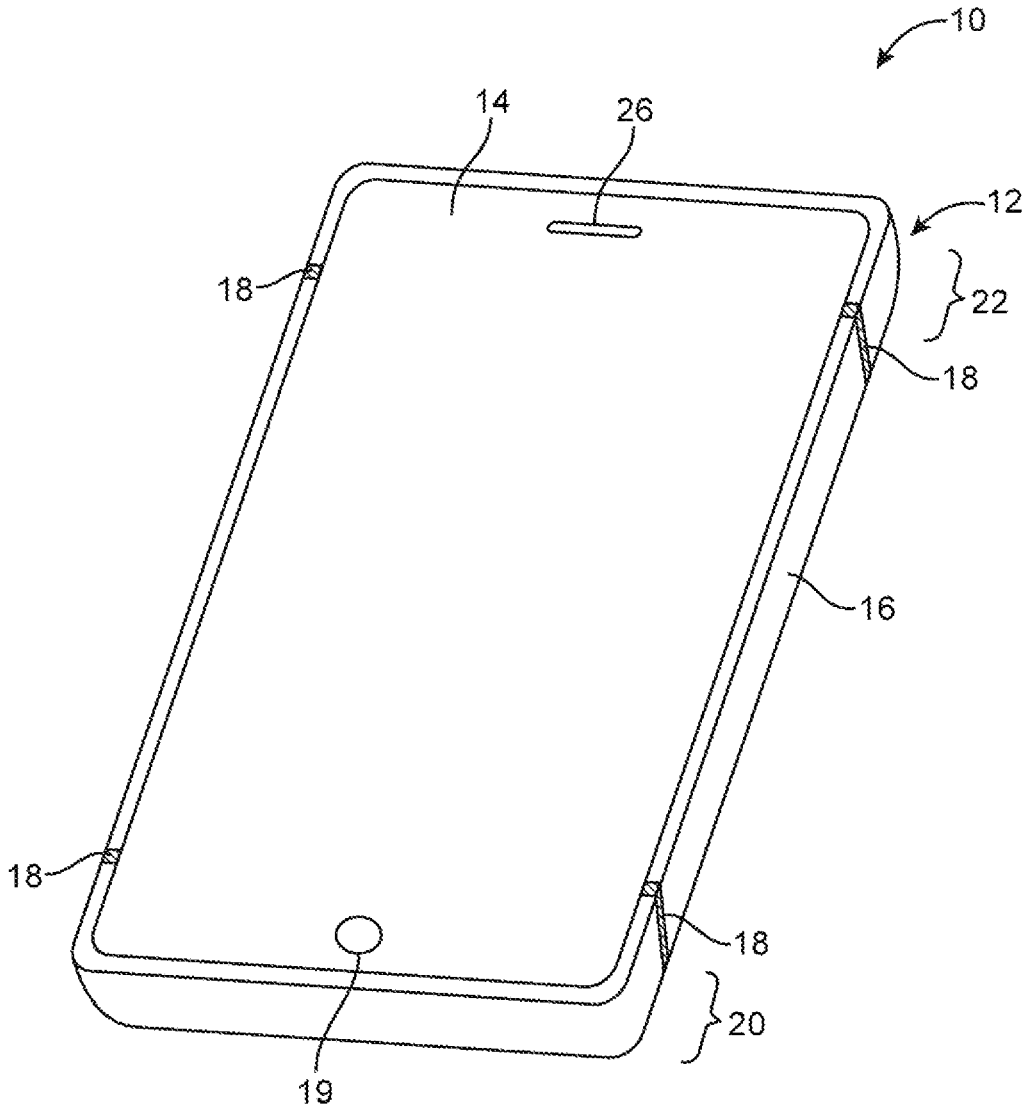
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include antenna structures such as antenna structures that include loop antennas, inverted-F antennas, strip antennas, planar inverted-F antennas, slot antennas, hybrid antennas that include antenna structures of more than one type, or other suitable antennas.

Antenna structures may, if desired, be formed from conductive electronic device structures. The conductive electronic device structures may include conductive housing structures. The housing structures may include a peripheral conductive member that runs around the periphery of an electronic device. The peripheral conductive member may serve as a bezel for a planar structure such as a display and/or may form vertical sidewalls for the device.

The antenna structures may be configured to handle both near field communications (e.g., communications in a near field communications band such as a 13.56 MHz band) and non-near-field communications (sometimes referred to as far field communications) such as cellular telephone communications, wireless local area network communications, and satellite navigation system communications. Near field communications typically involve communication distances of less than about 20 cm. Far field communications typically involved communication distances of multiple meters or miles.

Signal combining circuitry such as a duplexer or switching circuitry may be used to allow a near field communications transceiver and non-near-field-communications transceiver circuitry to share the antenna structures. By reducing or eliminating the need for separate near field communications antenna structures to handle near field communications signals, antenna structures that are shared between near field communication and non-near-field-communications circuitry can help minimize device size.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, a television, a computer monitor, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a cover glass layer or a layer of clear plastic may cover the surface of display 14. Buttons such as button 19 may pass through openings in the display cover layer or other outer layer in display 14. The cover glass may also have other openings such as an opening for speaker port 26.

Housing 12 may include a peripheral member such as member 16. Member 16 may run around the periphery of device 10 and display 14. In configurations in which device 10 and display 14 have a rectangular shape, member 16 may have a rectangular ring shape (as an example). Member 16 or part of member 16 may serve as a bezel for display 14 (e.g., a cosmetic trim that surrounds all four sides of display 14 and/or helps hold display 14 to device 10). Member 16 may also, if desired, form sidewall structures for device 10 (e.g., by forming a band with vertical sidewalls, by forming a band with rounded sidewalls, etc.).

Member 16 may be formed of a conductive material and may therefore sometimes be referred to as a peripheral conductive member or conductive housing structures. Member 16 may be formed from a metal such as stainless steel, aluminum, or other suitable materials. One, two, three, or more than three separate structures may be used in forming member 16.

It is not necessary for member 16 to have a uniform cross-section. For example, the top portion of member 16 may, if desired, have an inwardly protruding lip that helps hold display 14 in place. If desired, the bottom portion of member 16 may also have an enlarged lip (e.g., in the plane of the rear surface of device 10). In the example of FIG. 1, member 16 has substantially straight vertical sidewalls. This is merely illustrative. The sidewalls of member 16 may be curved or may have any other suitable shape. In some configurations (e.g., when member 16 serves as a bezel for display 14), member 16 may run around the lip of housing 12 (i.e., member 16 may cover only the edge of housing 12 that surrounds display 14 and not the rear edge of housing 12 of the sidewalls of housing 12).

Display 14 may include conductive structures such as an array of capacitive electrodes, conductive lines for addressing pixel elements, driver circuits, etc. Housing 12 may include internal structures such as metal frame members, a planar sheet metal housing structure (sometimes referred to as a midplate) that spans the walls of housing 12 (i.e., a substantially rectangular member that is welded or otherwise connected between opposing sides of member 16), printed circuit boards, and other internal conductive structures. These conductive structures may be located in the center of housing 12 under display 14 (as an example).

In regions 22 and 20, openings (gaps) may be formed within the conductive structures of device 10 (e.g., between peripheral conductive member 16 and opposing conductive structures such as conductive housing structures, a conductive ground plane associated with a printed circuit board, and conductive electrical components in device 10). These openings may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element arm from the ground plane, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of member 16 may be provided with gap structures. For example, member 16 may be provided with one or more gaps such as gaps 18, as shown in FIG. 1. The gaps may be filled with dielectric such as polymer, ceramic, glass, air, other dielectric materials, or combinations of these materials. Gaps 18 may divide member 16 into one or more peripheral conductive member segments. There may be, for example, two segments of member 16 (e.g., in an arrangement with two gaps), three segments of member 16 (e.g., in an arrangement with three gaps), four segments of member 16 (e.g., in an arrangement with four gaps, etc.). The segments of peripheral conductive member 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting non-near-field-communications such as local area network communications, voice and data cellular telephone communications, global positioning system (GPS) communications or other satellite navigation system communications, Bluetooth® communications, etc. Device 10 may use at least part of the same antenna structures for supporting near field communications (e.g., communications at 13.56 MHz).

Figure 2:
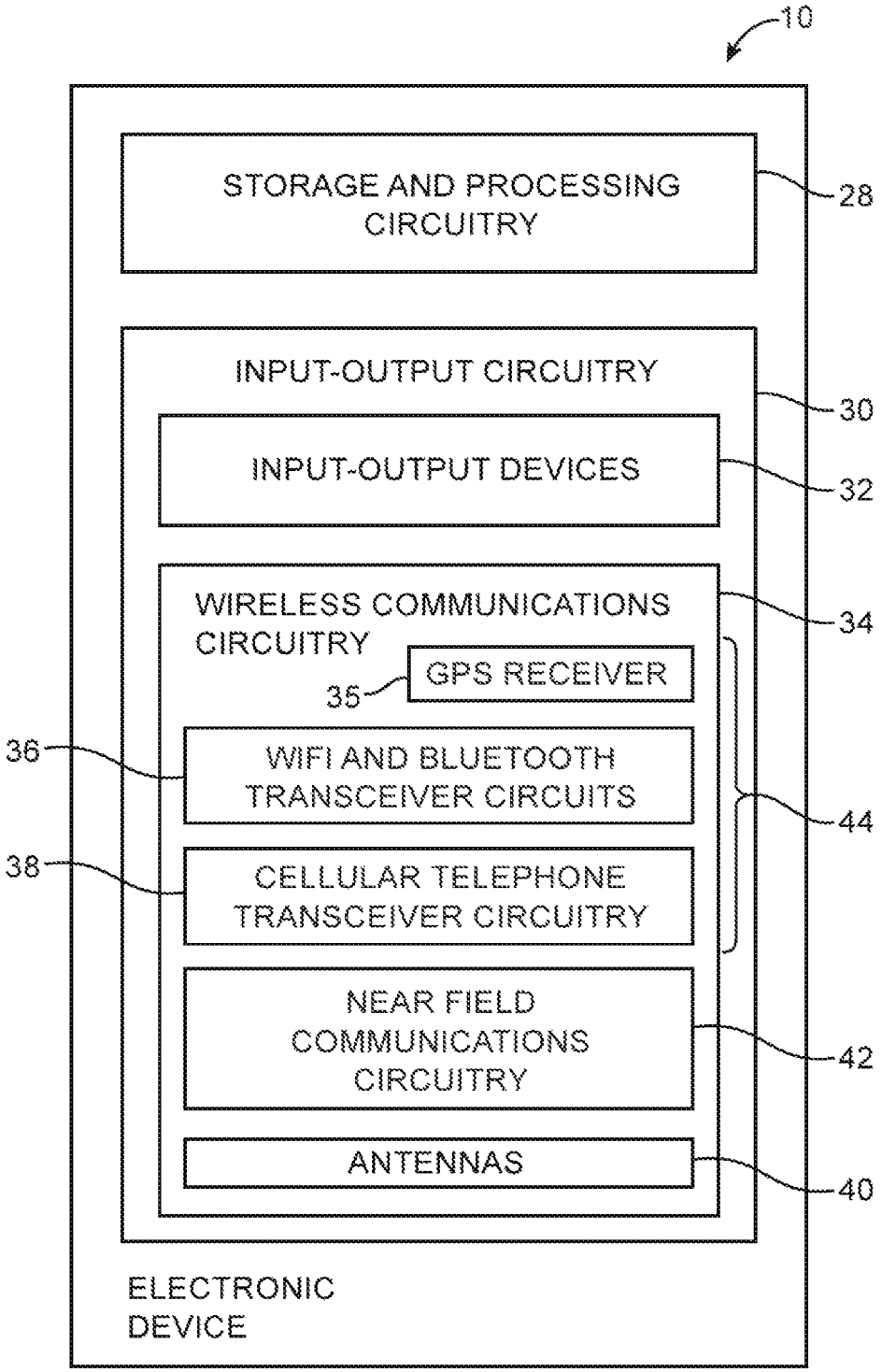
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, near field communications protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, may perform time-division multiplexing operations to share antenna structures between near field and non-near-field communications circuitry, etc. In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems.

Wireless local area network transceiver circuitry 36 in wireless communications circuitry 34 may handle 2.4 GHz and 5 GHz bands for WiFi® (IEEE 802.11) communications and may handle the 2.4 GHz Bluetooth® communications band.

Circuitry 34 may use cellular telephone transceiver circuitry 38 for handling wireless communications in cellular telephone bands such as bands in frequency ranges of about 700 MHz to about 2700 MHz or bands at higher or lower frequencies.

Wireless communications circuitry 34 may include near field communications circuitry 42. Near field communications circuitry 42 may handle near field communications at frequencies such as the near field communications frequency of 13.56 MHz or other near field communications frequencies of interest.

Circuitry 44 such as satellite navigation system receiver circuitry 35, wireless local area network transceiver circuitry 36, and cellular telephone transceiver circuitry 38 that does not involve near field communications may sometimes collectively be referred to as non-near-field communications circuitry or far field communications circuitry.

Antenna structures 40 may be shared by non-near-field communications circuitry 44 and near field communications circuitry 42.

If desired, communications circuitry 34 may include circuitry for other short-range and long-range wireless links. For example, wireless communications circuitry 34 may include wireless circuitry for receiving radio and television signals, paging circuits, etc. In near field communications, wireless signals are typically conveyed over distances of less than 20 cm. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antenna structures 40. Antenna structures 40 may include one or more antennas. Antennas structures 40 may be formed using any suitable antenna types. For example, antenna structures 40 may include antennas with resonating elements that are formed from loop antenna structure, patch antenna structures, inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link.

To accommodate near field communications within the potentially tight confines of device housing 12, antenna structures 40 may be shared between non-near-field communications circuitry 44 and near field communications circuitry 42. When, for example, it is desired to transmit and receive cellular telephone signals or other non-near-field communications, antenna structures 40 may be used by transceiver circuitry 38. When it is desired to transmit and receive near field communications signals, antenna structures 40 may be used to near field communications circuitry 42.

Figure 3:
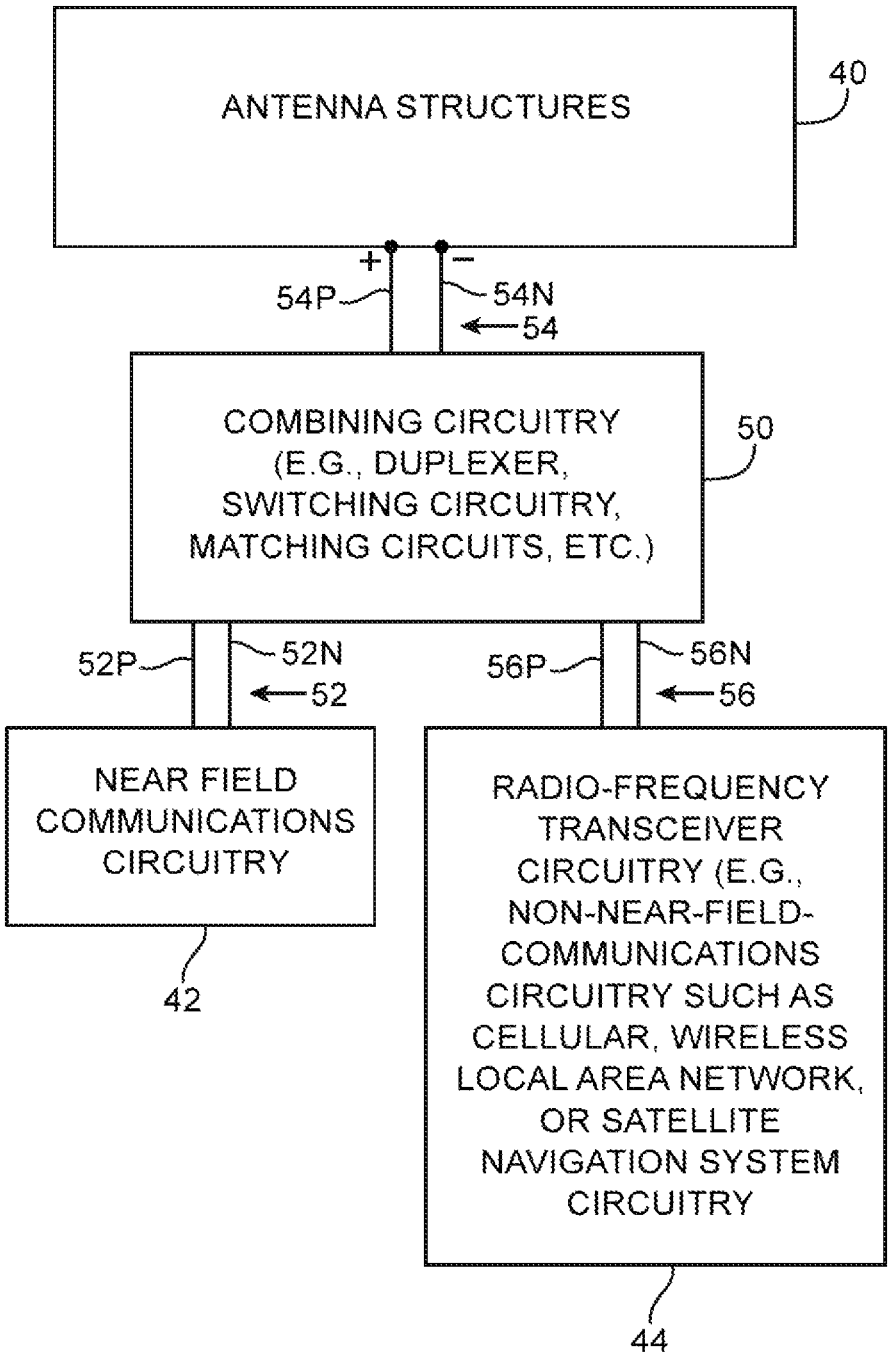
FIG. 3 is a diagram of illustrative electronic device wireless circuitry in accordance with an embodiment of the present invention.

FIG. 3 is a schematic diagram showing how antenna structures 40 may be shared by near field communications circuitry 42 and non-near-field communications circuitry 44. As shown in FIG. 3, near field communications circuitry 42 and non-near field communications circuitry 44 may be coupled to antenna structures 40 by combining circuitry 50. Combining circuitry 50 may include circuitry such as duplexer circuitry or switching circuitry. Combining circuitry 50 routes transmitted near field communications signals from near field communications circuitry 42 to antenna structures 40 and routes incoming near field communications signals received by antenna structures to near field communications circuitry 42. Combining circuitry 50 also routes non-near-field communications signals that are transmitted by circuitry 44 to antenna structures 40 and routes received non-near-field communications signals from antenna structures 40 to non-near-field communications circuitry 44. Matching circuitry in combining circuitry 50 may be used in facilitating impedance matching between antenna structures 40, circuitry 42, circuitry 44, and the signal paths that couple these circuits.

Combining circuitry 50 allows antenna structures 40 be used by both near field communications circuitry 42 and non-near-field communications circuitry 44. In configurations for combining circuitry that are based on actively switched circuits, control circuitry 28 can make adjustments to circuitry 50 and other circuitry in real time to ensure that near field communications signals and non-near-field communications signals are routed properly. In configurations for combining circuitry 50 that are implemented using passive components (e.g., a network of one or more components such as inductors, capacitors, resistors, etc. to form a duplexer), signals can be routed between antenna structures 40 and near field communications circuitry 42 and non-near-field communications circuitry 44 based on signal frequency (e.g., by routing lower frequency signals such as signals at 13.56 MHz between antenna structures 40 and near field communications circuitry 42 and by routing higher frequency signals such as signals above 700 MHz between antenna structures 40 and non-near-field-communications transceiver circuitry 44).

Paths such as paths 54, 52, and 56 may be used in routing signals between antenna structures 40 and transceiver circuitry 42 and 44.

Paths such paths 54, 52, and 56 may include pairs of signal lines. Each pair of signal lines may form a transmission line or part of a transmission line. Transmission lines in device 10 may be formed from coaxial cables, microstrip transmission lines or other transmission lines that are formed from metal traces on dielectric substrates (e.g., flexible printed circuit substrates formed from flexible layers of polyimide or other sheets of polymer or rigid printed circuit boards formed from fiberglass-filled epoxy), or other suitable transmission line structures.

As shown in the example of FIG. 3, path 52 may include a positive signal line such as positive signal line 52P and a ground signal line such as ground signal line 52N. Path 54 may include a positive signal line such as positive signal line 54P and a ground signal line such as ground signal line 54N. Path 56 may include a positive signal line such as positive signal line 56P and a ground signal line such as ground signal line 56N. Path 54 may be coupled to an antenna feed having a positive antenna feed terminal (+) and a ground antenna feed terminal (−) (i.e., path 54P may form a positive antenna feed line) or, if desired, other antenna feed structures may be used in feeding antenna structures 40.

If desired, antenna structures 40 may be provided with multiple antenna feeds and/or components that are actively tuned (e.g., switches that are controlled by control signals from control circuitry 28). Configuration in which antenna structures 40 are formed from passive components and have a single antenna feed are sometimes described herein as an example.

Figure 4:
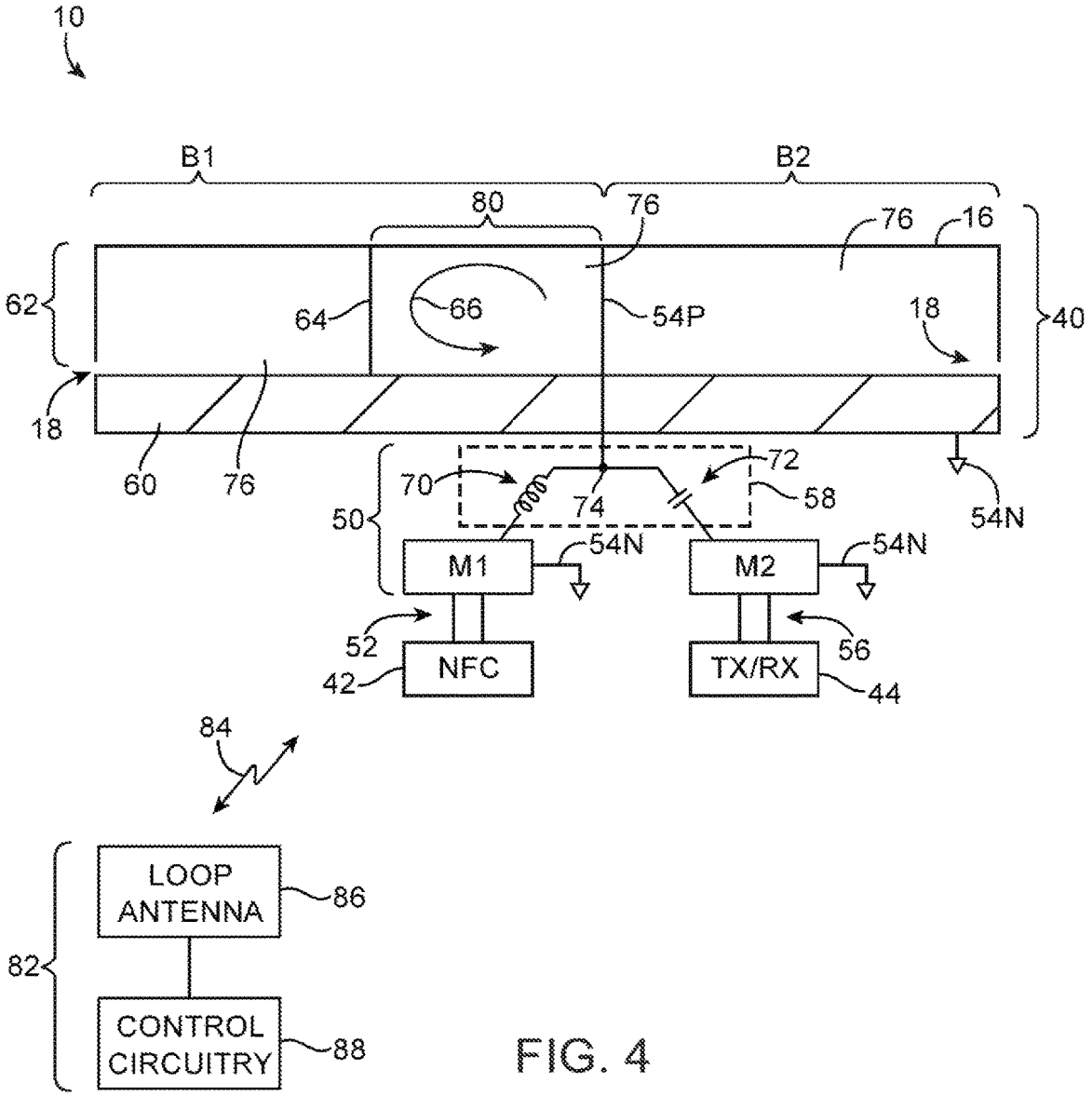
FIG. 4 is a diagram of illustrative antenna structures coupled to near field communications circuitry and non-near-field-communications circuitry in accordance with an embodiment of the present invention.

FIG. 4 is a diagram of illustrative antenna structures of the type that may be shared by near field communications circuitry and non-near-field communications circuitry. As shown in FIG. 4, combining circuitry 50 may have an antenna feed port coupled to antenna structures 40. Combining circuitry 50 may also include a near field communications port for handling signals associated with near field communications circuitry 42 such as the port that is coupled to near field communications circuitry 42 by path 52. Impedance matching circuitry M1 may be used to help ensure that path 52 is impedance matched (e.g., to help create a 50 ohm impedance for circuitry 50 that is matched to a 50 ohm impedance for path 52). Combining circuitry 50 may include a non-near-field communications port for handling signals associated with non-near-field-communications circuitry 44 such as the port that is coupled to non-near-field communications circuitry 44 by path 56. Impedance matching circuitry M2 may be used to help ensure that path 56 is impedance matched (e.g., to help create a 50 ohm impedance for circuitry 50 that is matched to a 50 ohm impedance for path 56.

Combining circuitry 50 may include switching circuitry or passive circuitry for multiplexing the near field communications signals associated with near field communications circuitry 42 and the non-near-field communications signals associated with non-near-field communications circuitry 44. In the example of FIG. 4, combining circuitry 50 includes a passive circuit that performs multiplexing (and demultiplexing) operations based on the frequency of the signals. In particular, combining circuitry 50 includes duplexer 58.

Duplexer 58 includes duplexing circuitry such as inductor 70 and capacitor 72. This circuitry allows duplexer 58 to route signals between antenna structures 40 and circuits 42 and 44 based on signal frequency. For example, the inductance value for inductor 70 may be selected so that inductor 70 exhibits a low impedance (i.e., a short circuit condition) at relatively low frequencies such as the frequencies associated with near field communications circuitry 42 (e.g., 13.56 MHz). Inductor 70 therefore allows these signals to pass from near field communications circuitry 42 to antenna structures 40 during signal transmission operations and to pass from antenna structures 40 to near field communications circuitry 42 during signal reception operations. The capacitance value for capacitor 72 may be selected so that capacitor 72 exhibits a high impedance (i.e., an open circuit condition) at relatively low frequencies such as the frequencies associated with near field communications circuitry 42 (e.g., 13.56 MHz) and thereby prevents near field communications signals from passing to non-near-field communications circuitry 44 (i.e., capacitor 58 prevents near field communications signals from interfering with the operation of non-near-field communications circuitry 44).

At high frequencies such as frequencies above 700 MHz that are associated with the operation of non-near-field communications circuitry 44, inductor 70 will exhibit a high impedance (i.e., inductor 70 will form an open circuit). This will prevent potentially interfering non-near-field communications signals associated with circuitry 44 from reaching near field communications circuitry 42. At the relatively high frequencies associated with non-near-field communications signals for circuitry 44, capacitor 72 will exhibit a relatively low impedance (i.e., capacitor 72 will form a short circuit), so that circuitry 44 can transmit and receive signals using antenna structures 40.

Antenna structures 40 may include an antenna resonating element and an antenna ground. In the example of FIG. 4, antenna structures 40 include inverted-F antenna resonating element 62 and antenna ground 60. Other antenna configurations may be used for antenna structures 40 if desired. The example of FIG. 4 is merely illustrative.

Inverted-F antenna resonating element 62 may, as an example, have a main arm that is formed from a segment of peripheral conductive housing member 16 of FIG. 1, extending between gaps in member 16 such as gaps 18. Ground 60 may include other portions of member 16, internal printed circuit board structure, internal device circuitry and structures such as radio-frequency shielding cans, mounting structures, metal portions of cameras and other components, metal brackets, etc. If desired, other configurations may be used for forming antenna structures 40. For example, antenna structures 40 may be formed using patterned metal traces on rigid and/or flexible printed circuits or from metal traces formed on plastic carriers.

Antenna resonating element 62 may have resonating element arm portions such as low band branch B1, which contributes to an antenna resonance in a lower portion of the 700-2700 MHz cellular telephone spectrum (or other suitable frequency), and high band branch B2, which contributes to an antenna resonance in an upper portion of the 700-2700 MHz spectrum. Antenna resonating element arms B1 and B2 may be configured to exhibit resonances that cover cellular telephone frequencies, satellite navigation system frequencies, wireless local area network frequencies, or other suitable wireless frequencies when antenna structures 40 are operating in an inverted-F antenna mode.

Opening 76 is located between the main resonating element arm structure formed from branches B1 and B2 and antenna ground 60. Opening 76 may be filled with a dielectric such as air and/or dielectric such as plastic and other dielectric materials associated with the housing and components of device 10. Short circuit path 64 spans opening 76 and forms a return path between the main resonating element arm of resonating element 62 and antenna ground 60. Antenna feed path 54P spans opening 76 and is coupled to node 74 in duplexer circuitry 58. Node 74 and feed path 54P may form an antenna feed port for combining circuitry 50.

With a sharing configuration of the type shown in FIG. 4, near field communications circuitry 42 and non-near-field communications circuitry 44 can use antenna structures 40 separately or at the same time. When using antenna structures 40 to handle signals associated with non-near-field communications circuitry 44, antenna resonating element arm B1 may give rise to an antenna resonance in a first (e.g., lower) communications band and antenna resonating element arm B2 may give rise to an antenna resonance in a second (e.g., higher) communications band (as an example). When using antenna structures 40 to handle near field communications signals associated with near field communications circuitry 42, loop current signals such as loop current 66 of FIG. 4 may be generated in antenna structures 40.

Loop current signals 66 may, for example, circulate in the antenna loop formed by path 54P, segment 80 of resonating element arm B1, short circuit path 64, and antenna ground 60 (which is grounded to ground path 54N in path 54). Loop currents 66 may be induced in antenna structures 40 when antenna structures 40 are exposed to incoming near field communications signals 84 from external equipment 82 and/or may be generated by near field communications circuitry 42. The conductive loop of structures formed by path 54P, segment 80 of resonating element arm B1, short circuit path 64, and antenna ground 60 that supports loop currents 66 serves as a loop antenna for near field communications circuitry 42.

External equipment such as external equipment 82 may communicate with near field communications circuitry 42 via magnetic induction. Equipment 82 may include a loop antenna such as loop antenna 86 that is controlled by control circuitry 88. Loop antenna 86 and the loop antenna formed from antenna structures 40 are electromagnetically coupled, as indicated by near field communications signals 84 of FIG. 4. Device 10 may use near field communications circuitry 42 and antenna structures 40 (e.g., the near field communications loop antenna portion of antenna structures 40) to communicate with external near field communications equipment 82 using passive or active communications. In passive communications, device 10 may use near field communications circuitry 42 and antenna structures 40 to modulate electromagnetic signals 84 from equipment 82. In active communications, near field communications circuitry 42 and antenna structures 40 may transmit radio-frequency electromagnetic signals 84 to external equipment 82.

Figure 5:
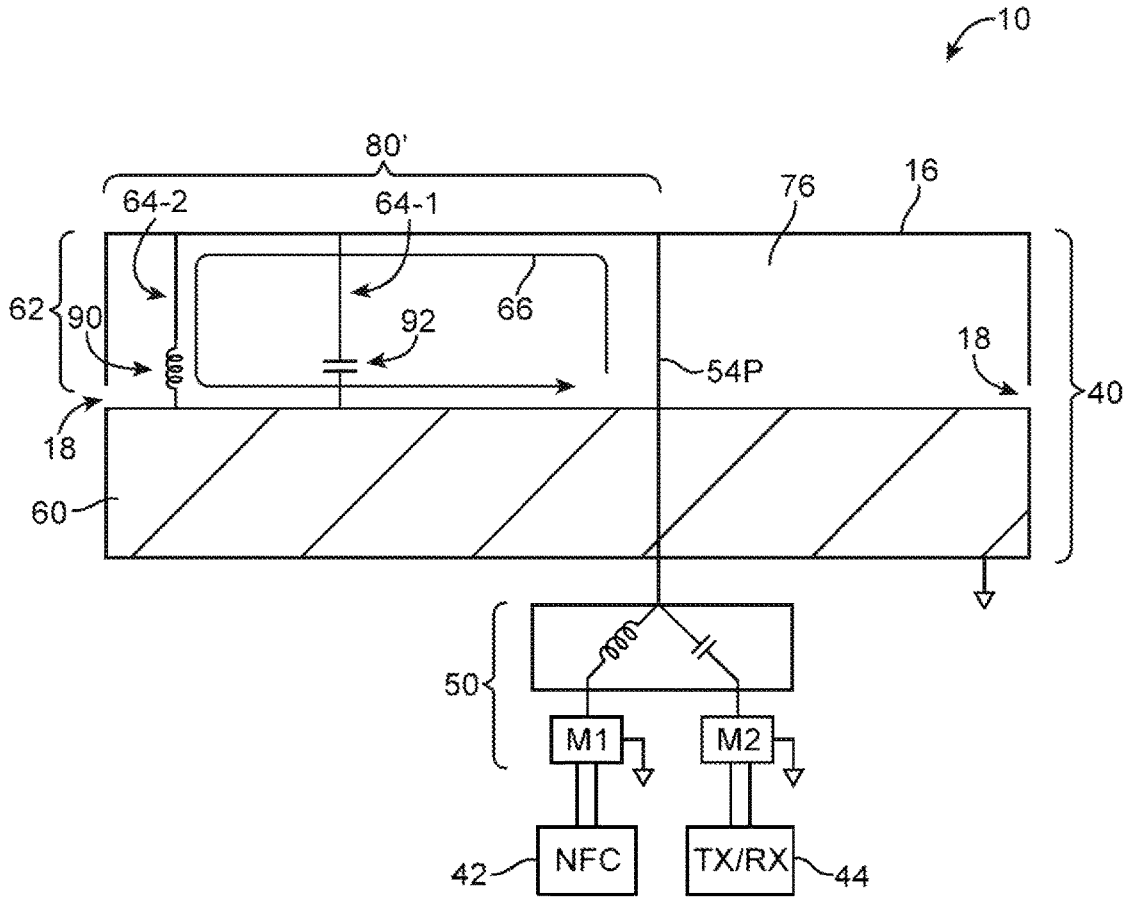
FIG. 5 is a diagram of illustrative antenna structures coupled to near field communications circuitry and non-near-field communications circuitry using coupling circuitry such as a duplexer in accordance with an embodiment of the present invention.

FIG. 5 is a diagram of device 10 in a configuration in which antenna structures 40 have been provided with a supplemental loop mode return path such as return path 64-2. Return path 64-2, which may sometimes be referred to as short circuit path 64-2, may span gap 76 in parallel with return path 64-1 (sometimes referred to as short circuit path 64-1). Inductor 90 may be interposed within path 64-1. Inductor 90 may be characterized by a high impedance at high frequencies (e.g., frequencies above 700 MHz) and may be characterized by a low impedance at low frequencies (e.g., frequencies below 700 MHz or below 100 MHz such as a near field communications frequency of 13.56 MHz). Capacitor 92 may be characterized by a low impedance at high frequencies (e.g., frequencies above 700 MHz) and may be characterized by a high impedance at low frequencies (e.g., frequencies below 700 MHz or below 100 MHz such as a near field communications frequency of 13.56 MHz).

During operation of non-near-field communications circuitry 44 at frequencies above 700 MHz, path 64-1 forms a short circuit that spans gap 76 and forms a return path between the main antenna resonating element arm in inverted-F antenna resonating element 62 and ground 60 (as with short circuit path 64 of FIG. 4), whereas path 64-2 forms an open circuit. In this scenario, path 64-2 will not contribute significantly to the performance of antenna structures 40 and antenna structures 40 will serve as a two-arm dual band inverted-F antenna for non-near-field communications circuitry 44.

During operation of near field communications circuitry 42 at frequencies below 700 MHz (e.g., at a frequency below 100 MHz such as in a near field communications band at 13.56 MHz), capacitor 92 exhibits a high impedance so that path 64-1 forms an open circuit and does not participate in the performance of antenna structures 40. Inductor 90 exhibits a low impedance, so that path 64-2 shorts segment 80' to ground 60 and forms part of a near field communications loop antenna. In this configuration, loop currents flow through the loop antenna structures formed from feed path 54P, segment 80' of the main resonating element arm of resonating element 62, short circuit path 64-2, and ground 60, as illustrated by loop currents 66 of FIG. 5.

Figure 6:
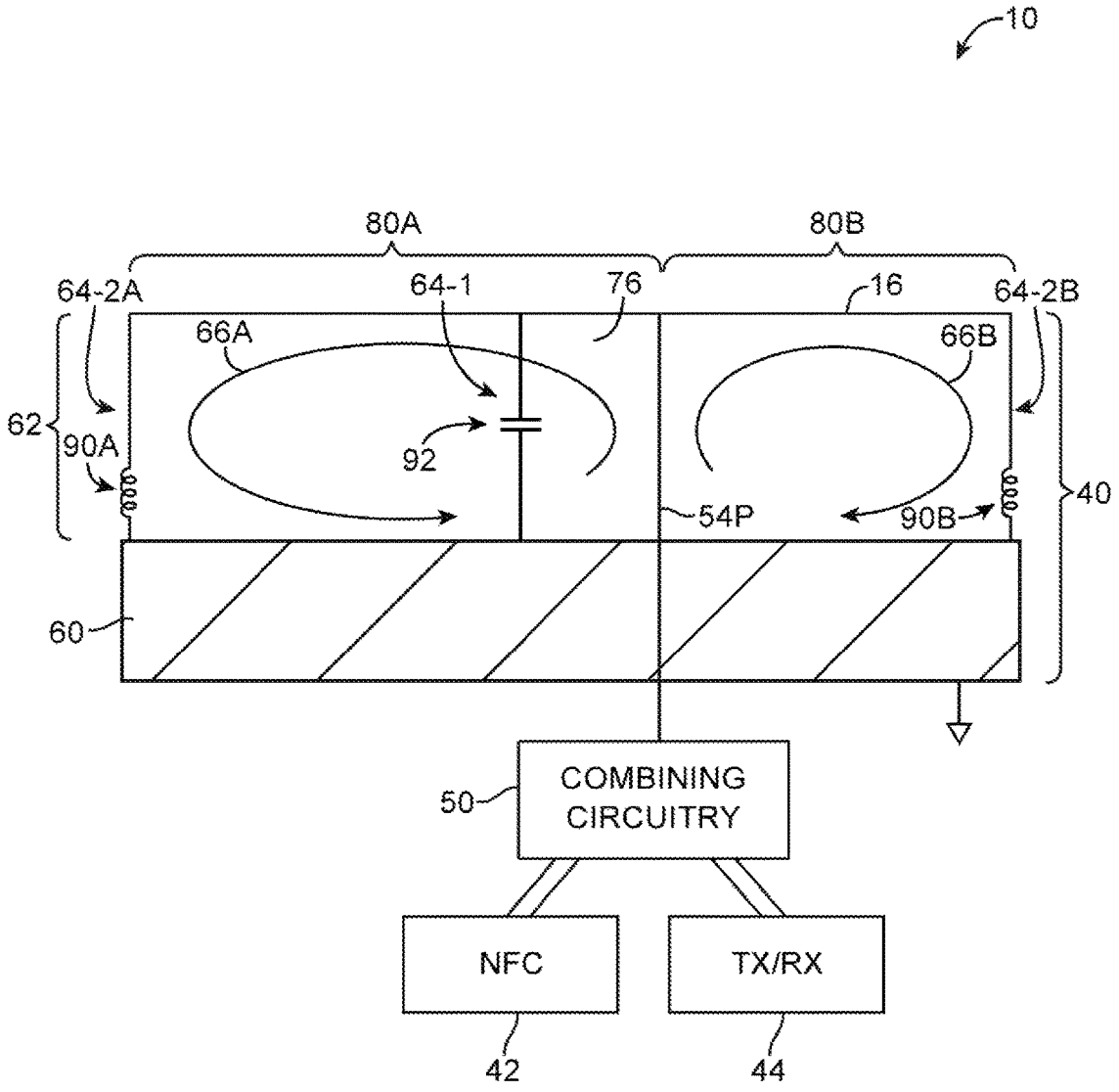
FIG. 6 is a diagram of illustrative antenna structures in a configuration in which near field communications circuitry and non-near-field communications circuitry are coupled to the antenna structures and in which the antenna structures form multiple loops at different locations within the antenna structures when operating at near field communications frequencies in accordance with an embodiment of the present invention.

In the illustrative configuration of FIG. 6, antenna structures 40 have been provided with parallel paths 90A and 90B spanning gap 76. Path 64-1 forms a short circuit return path between the main arm of antenna resonating element 62 and ground 60 at frequencies above 700 MHz (e.g., when using non-near-field communications circuitry 44). Path 64-1 forms an open circuit at near field communications frequencies (e.g., frequencies below 700 MHz, below 100 MHz, 13.56 MHz, etc.).

Paths 64-2A and 64-2B span opposing ends of gap 76. If desired, inductors 90A and 90B may span gaps in housing band 16 such as gaps 18 of FIG. 1. Inductor 90A in path 64-2A and inductor 90B in path 64-B may exhibit low impedances at low frequencies (e.g., frequencies below 700 MHz, below 100 MHz, 13.56 MHz, etc.), so that paths 64-2A and 64-2B form return paths for near field communications circuitry 42. As shown in FIG. 6, path 54P, segment 80A of the main resonating element arm, path 64-2A, and ground 60 may form a first loop antenna structure within antenna structures 40 (i.e., a loop antenna in which loop currents 66A circulate). At the same time, path 54P, segment 80B of the main resonating element arm, path 64-2B, and ground 60 may form a second loop antenna structure within antenna structures 40 (i.e., a loop antenna in which loop currents 66B circulate). The use of multiple antenna loops within antenna structures 40 may increase near field communications efficiency (i.e., antenna structures 40 may exhibit enhanced near field communications loop antenna efficiency compared to single-loop configurations).

Figure 7:
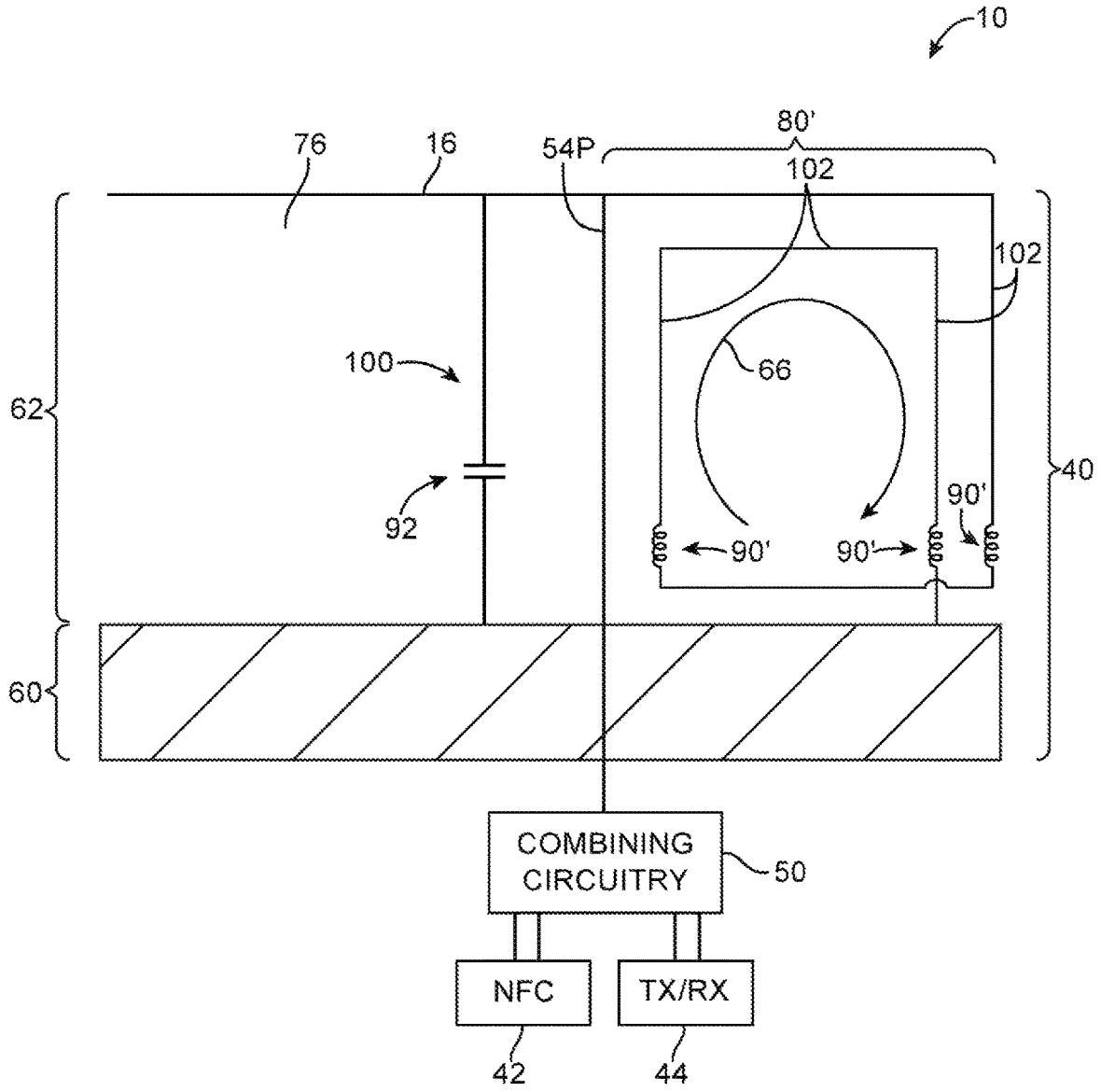
FIG. 7 is a diagram of illustrative antenna structures in a configuration in which near field communications circuitry and non-near-field communications circuitry are coupled to the antenna structures and in which the antenna structures form a multi-turn loop antenna when operated at near field communications frequencies in accordance with an embodiment of the present invention.

If desired, the conductive structures in antenna structures 40 may be configured to form multiple overlapping loops (i.e., multiple turns in a multi-loop antenna), as shown in FIG. 7. In antenna structures 40 of FIG. 7, capacitor 92 is interposed in path 100 so that path 100 forms a short circuit at non-near-field communications frequencies (e.g., frequencies above 700 MHz). Inductors 90' form open circuits at these frequencies, so that paths 102 are effectively removed from antenna structures 40 and do not affect antenna performance for signals associated with non-near-field communications circuitry 44.

At near field communications frequencies (e.g., frequencies below 700 MHz or below 100 MHz such as frequencies in a near field communications band at 13.56 MHz), capacitor 92 may have a high impedance and path 100 may form an open circuit. Inductors 90' may exhibit low impedances, so that paths 102 (in conjunction with path 54P, segment 80" of the main resonating element arm in resonating element 62, and ground 60) form multiple concentric loops. The concentric loops form a near field communications loop antenna portion of antenna structures 40. In the example of FIG. 7, the near field loop antenna portion of antenna structures 40 has two concentric loops. Loop antenna configurations with three or more concentric loops may be formed if desired.

Figure 8:
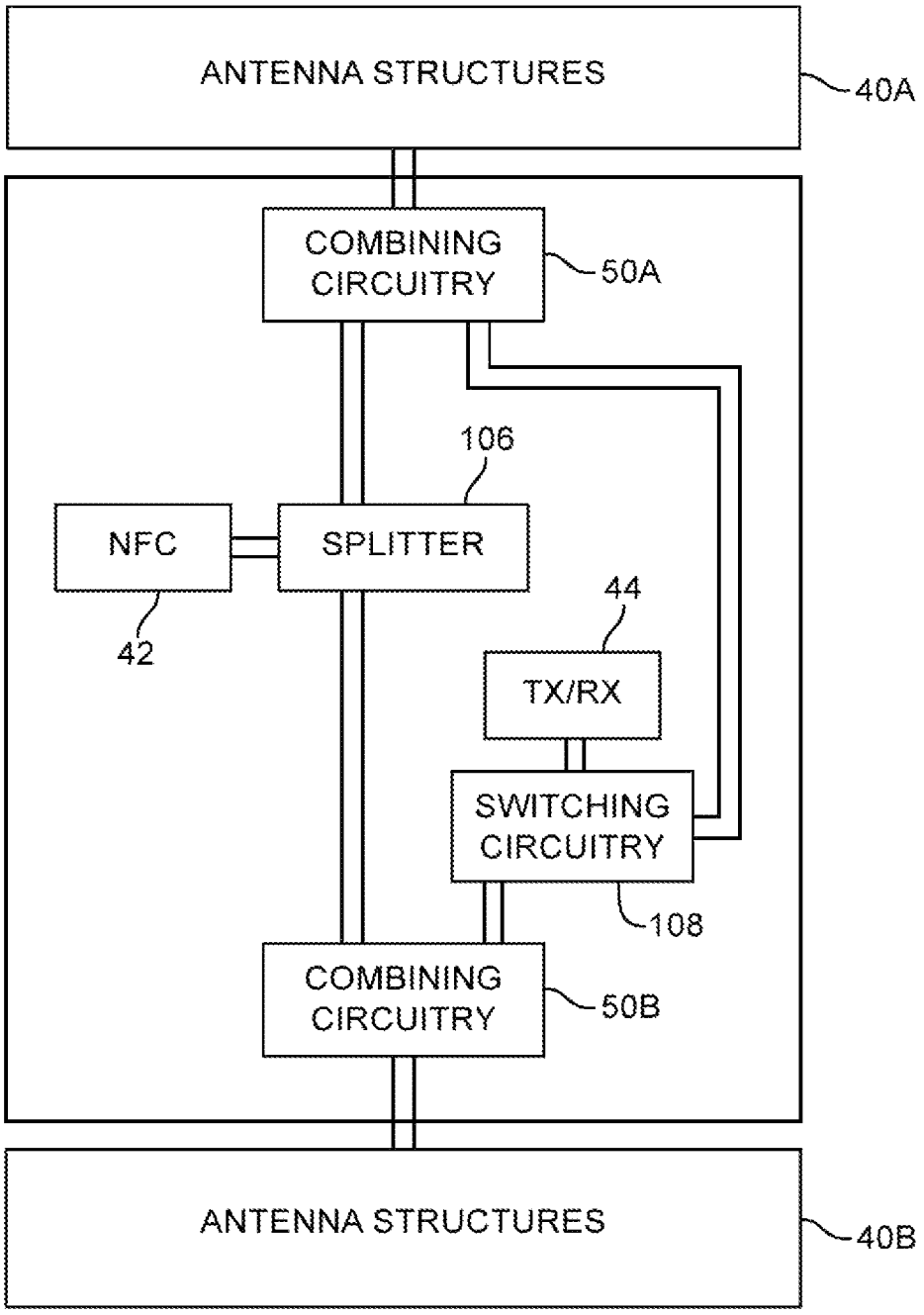
FIG. 8 is a diagram of an illustrative electronic device having multiple antennas such as antennas located at opposing ends of a device housing and having circuitry that allows near field communications circuitry and non-near-field-communications circuitry to use the antennas in accordance with an embodiment of the present invention.

FIG. 8 is a diagram of device 10 showing how antenna structures may be formed at opposing ends of housing 12, as described in connection with antenna regions 20 and 22 of FIG. 1. As shown in FIG. 8, device 10 may have first antenna structures 40A and second antenna structures 40B. Antenna structures 40A and 40B may be based on inverted-F antennas, loop antennas, patch antennas, planar inverted-F antennas, or other suitable antennas. Near field communications loop antennas may be formed within antenna structures 40A and 40B. Splitter 106 may be used to route signals between near field communications circuitry 42 and antenna structures 40A and 40B. Splitter 106 may be implemented using a passive splitter circuit and/or using switching circuitry that actively switches antenna structures 40A or antenna structures 40B into use.

As described in connection with combining circuitry 50, combining circuitry 50A and 50B may be used as multiplexing circuits so that non-near-field communications circuitry 44 can share antenna structures 40A and 40B with near field communications circuitry 42. Switching circuitry 108 may be used to couple non-near-field communications circuitry 44 to antenna structures 40A or antenna structures 40B (e.g., antenna structures 40A or 40B may be switched into use based on signal strength criteria, proximity sensor signals, or other suitable antenna selection criteria).

Antenna structures 40A and 40B may each include structures that form a loop antenna portion for near field communications as described in connection with FIGS. 4, 5, 6, and 7. Combining circuitry 50A may be used to couple near field communications circuitry 42 (via splitter 106) to antenna structures 40A while coupling non-near-field communications circuitry 44 (via switching circuitry 108) to antenna structures 40A. Combining circuitry 50B may be used to couple near field communications circuitry 42 (via splitter 106) to antenna structures 40B while coupling non-near-field communications circuitry 44 (via switching circuitry 108) to antenna structures 40B.

Figure 9:
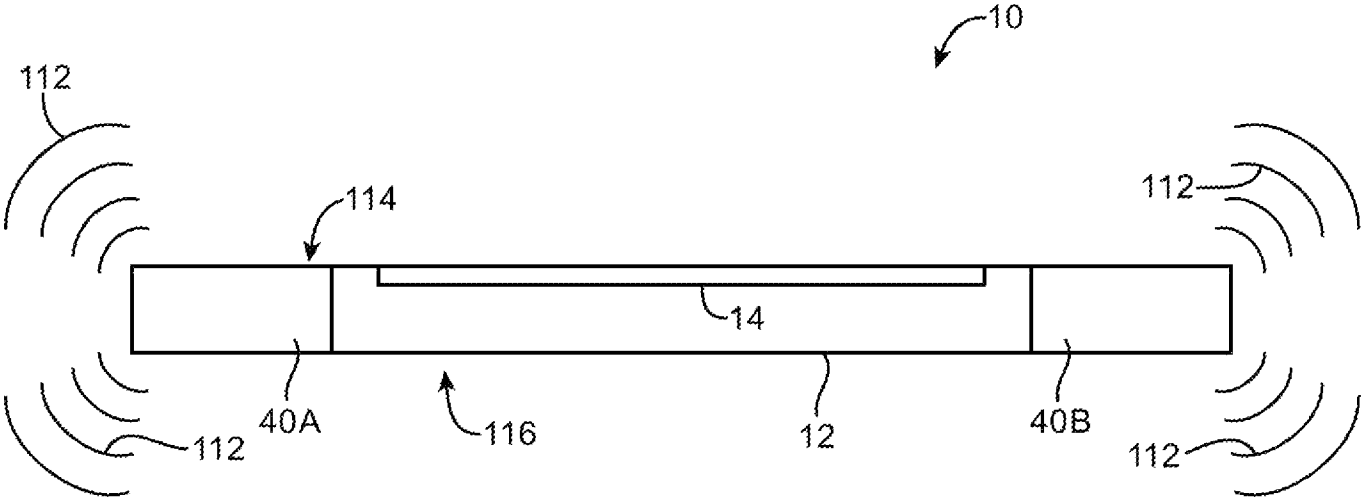
FIG. 9 is a cross-sectional diagram of an illustrative electronic device of the type shown in FIG. 8 showing how antenna signals may be emitted and received from both ends of the device and from both front and rear faces of the device in accordance with an embodiment of the present invention.

As shown in FIG. 9, antenna structures 40A and 40B may be configured to emit and receive radio-frequency signals 112 from both the front face of device 10 (surface 114) and from the rear face of device 10 (surface 116). With this type of arrangement, device 10 may communicate with external near field communications equipment 82 (FIG. 4) regardless of whether device 10 is being held in a display up orientation (as shown in FIG. 9) or display down configuration. The use of splitter 42 allows a user to use a loop antenna at either end of device 10 (or both) to support near field communications.

The foregoing is merely illustrative of the principles of this invention and various modifications can be made by those skilled in the art without departing from the scope and spirit of the invention.

What is claimed is:

1. An electronic device, comprising:

an inverted-F antenna resonating element;

an antenna ground that is separated from the inverted-F antenna resonating element by an opening;

a first path that is coupled between the antenna ground and the inverted-F antenna resonating element and that spans the opening;

a second path that is coupled between the antenna ground and the inverted-F antenna resonating element and that spans the opening;

an antenna feed path that is coupled to the inverted-F antenna resonating element;

non-near-field communications circuitry coupled to the antenna feed path that transmits and receives signals in a non-near-field communications signal band in which the second path forms a short circuit across the opening and serves as a return path for the inverted-F antenna resonating element and in which the first path forms an open circuit; and near field communications circuitry coupled to the antenna feed path that transmits and receives near field communications in a near field communications band in which the first path forms a short circuit across the opening and serves as a portion of a near field communications loop antenna and in which the second path forms an open circuit.

2. The electronic device defined in claim 1 further comprising a conductive peripheral housing member that surrounds a peripheral edge of the electronic device, wherein the inverted-F antenna resonating element is formed from a segment of the conductive peripheral housing member.

3. The electronic device defined in claim 1 wherein an inductor is interposed on the first path.

4. The electronic device defined in claim 3 wherein the first path has a first end that is coupled to the inverted-F antenna resonating element and a second end that is coupled to the antenna ground.

5. The electronic device defined in claim 4 wherein the inverted-F antenna resonating element includes a portion of a conductive peripheral housing member that surrounds a peripheral edge of the electronic device.

6. The electronic device defined in claim 1 further comprising a capacitor interposed on the second path.

7. The electronic device defined in claim 4 further comprising a duplexer, wherein the duplexer has a feed port coupled to the antenna feed path, a near field communications port coupled to the near field communications circuitry, and a non-near-field communications port coupled to the non-near-field communications circuitry.

8. The electronic device defined in claim 7 wherein the non-near-field communications circuitry comprises cellular telephone transceiver circuitry and the non-near-field communications signal band comprises a cellular telephone band above 700 MHz.

9. The electronic device defined in claim 8 wherein the near field communications circuitry is configured to operate in a near field communications band at 13.56 MHz.

10. The electronic device defined in claim 7 wherein the duplexer has a first path that is coupled between the antenna feed path and the near field communications circuitry and has a second path that is coupled between the antenna feed path and the non-near-field communications circuitry, and the duplexer comprises an inductor in the first path and a capacitor in the second path.

11. Antenna structures in an electronic device having a length, a width, and a height, the antenna structures comprising:

an inverted-F antenna resonating element formed from metal structures, wherein the metal structures extend across the width and the height of the electronic device;

an antenna ground that is separated from the metal structures by an opening;

an antenna feed path that is coupled to the inverted-F antenna resonating element, wherein the inverted-F antenna resonating element and antenna ground are configured to exhibit an antenna resonance in a communications band above 700 MHz and at least part of the metal structures form a near field communications loop antenna that is configured to transmit near field communications signals in a near field communications band;

a first path coupled between the inverted-F antenna resonating element and the antenna ground across the opening; and a second path coupled between the inverted-F antenna resonating element and the antenna ground across the opening, wherein the first path forms a short circuit across the opening that forms a portion of the near field communications loop antenna and the second path forms an open circuit in the near field communications band, and the second path forms a short circuit across the opening that forms a return path for the inverted-F antenna resonating element and the first path forms an open circuit in the communications band above 700 MHz.

12. The antenna structures defined in claim 11 wherein the near field communications band comprises a 13.56 MHz band and wherein the metal structures comprise metal electronic device housing structures.

13. The electronic device defined in claim 2, wherein the segment of the conductive peripheral housing member forms at least one exterior surface of the electronic device.

14. The electronic device defined in claim 13, wherein the electronic device has a length, a width that is less than the length, and a height that is less than the width, and the segment of the conductive peripheral housing member extends across the width and the height of the electronic device.

15. The electronic device defined in claim 14, wherein the segment of the conductive peripheral housing member comprises first, second, and third portions, the first portion extends across the width of the electronic device, and the second and third portions extend parallel to the length of the electronic device.

16. The electronic device defined in claim 15, wherein the second portion is separated from the antenna ground structures by a first dielectric gap in the conductive peripheral housing member and the third portion is separated from the antenna ground structures by a second dielectric gap in the conductive peripheral housing member.

17. The electronic device defined in claim 1, wherein the electronic device has a length, a width that is less than the length, and a height that is less than the width, the inverted-F antenna resonating element includes a portion of a conductive peripheral housing member that runs along a periphery of the electronic device, the portion of the conductive peripheral housing member extends across the width and the height of the electronic device, and the antenna ground extends across the width of the electronic device.

18. The electronic device defined in claim 10, further comprising:

a first impedance matching circuit coupled between the inductor and the near field communications circuitry; and a second impedance matching circuit that is separate from the first impedance matching circuit coupled between the capacitor and the non-near-field communications circuitry.

19. The antenna structures defined in claim 11, wherein an inductor is interposed in the first path and a capacitor is interposed in the second path.

20. The electronic device defined in claim 1, wherein the second path is interposed between the antenna feed path and the first path.

21. The electronic device defined in claim 20 further comprising a conductive peripheral housing member that surrounds a peripheral edge of the electronic device, wherein the inverted-F antenna resonating element is formed from a segment of the conductive peripheral housing member.

* * * * *